United States Patent [19]

Lorenz

[11] Patent Number: 4,709,543

[45] Date of Patent: Dec. 1, 1987

[54] PRE-TAKE-UP ROLLER MECHANISM FOR VARYING THE TENSION ON A RUNNING THREAD IN A THREAD PROCESSING MACHINE

[75] Inventor: Rainer Lorenz, Nettetal-Breyell, Fed. Rep. of Germany

[73] Assignee: Palitex Project-Company GmbH, Krefeld, Fed. Rep. of Germany

[21] Appl. No.: 910,893

[22] Filed: Sep. 23, 1986

Related U.S. Application Data

[63] Continuation-in-part of Ser. No. 692,683, Jan. 18, 1985, abandoned.

[30] Foreign Application Priority Data

Jan. 31, 1984 [DE] Fed. Rep. of Germany ..... 3403144

[51] Int. Cl.[4] ..... B65H 59/18; D01H 1/10; D01H 13/02

[52] U.S. Cl. ..... 57/58.7; 57/58.86; 57/90; 242/147 M; 242/155 M

[58] Field of Search ..... 57/58.7, 58.38, 58.83, 57/58.86, 90, 100, 62; 242/84.52 B, 147 M, 155 M; 226/188, 190, 193; 464/29

[56] References Cited

U.S. PATENT DOCUMENTS

| | | | |
|---|---|---|---|
| 2,123,936 | 7/1938 | Dreyfus et al. | 242/156.2 X |
| 2,550,136 | 4/1951 | Clarkson | 57/58.70 X |
| 2,921,429 | 1/1960 | Haugwitz | 57/58.7 X |
| 3,808,789 | 5/1974 | Hurley | 57/58.7 |
| 4,168,605 | 9/1979 | D'Agnolo | 57/58.7 X |
| 4,346,551 | 8/1982 | Yanobu et al. | 57/58.7 X |

FOREIGN PATENT DOCUMENTS

| | | | |
|---|---|---|---|
| 204563 | 11/1956 | Australia . | |
| 551896 | 1/1958 | Canada . | |
| 143816 | 11/1981 | Japan | 464/29 |
| 164478 | 11/1983 | Japan | 242/84.52 B |
| 555183 | 6/1977 | U.S.S.R. | 242/155 M |

*Primary Examiner*—Stuart S. Levy
*Assistant Examiner*—Joseph J. Hail, III
*Attorney, Agent, or Firm*—Bell, Seltzer, Park & Gibson

[57] ABSTRACT

A pre-take-up roller mechanism is provided for varying the tractive force and tension on running thread being wound by a take-up mechanism in a thread processing machine. The mechanism includes a variably driven rotating drive shaft carried by the machine, a thread pre-take-up roller rotatably mounted on the drive shaft for receiving the running thread on the surface thereof and for being driven by the running thread through adhesion, and an eddy current clutch or a combination eddy current and hysteresis clutch operatively connecting the drive shaft and the pre-take-up roller for varying the torque on the pre-take-up roller and thus the tractive force and tension on the running thread by varying the driven rotational speed of the drive shaft without affecting the constant winding speed of the running thread being wound by the take-up mechanism.

10 Claims, 10 Drawing Figures

CHARACTERISTIC CURVE OF EDDY-CURRENT CLUTCH DRIVEN PRE- TAKE-UP ROLLER

CHARACTERISTIC CURVE COMBINATION EDDY-CURRENT AND HYSTERESIS CLUTCH DRIVEN PRE- TAKE-UP ROLLER

CHARACTERISTIC CURVE OF HYSTERESIS CLUTCH DRIVEN PRE-TAKE-UP ROLLER

PRE-TAKE-UP ROLLER MECHANISM FOR VARYING THE TENSION ON A RUNNING THREAD IN A THREAD PROCESSING MACHINE

REFERENCE TO EARLIER FILED APPLICATION

This is a continuation-in-part application of my copending application Ser. No. 692,683, filed Jan. 18, 1985 which is now abandoned.

FIELD OF THE INVENTION

This invention relates to an improved pre-take-up roller mechanism for varying the tractive force and tension on a running thread being wound by a take-up mechanism in a thread processing machine, preferably a two-for-one twister, and positioned in the machine in advance of the take-up mechanism in the running thread path.

BACKGROUND OF THE INVENTION

In thread processing machines, particularly two-for-one twisters, the thread coming from the processing or twisting spindle assembly ordinarily has a very high tension which adversely affects winding of the processed thread at the take-up mechanism. Accordingly, a driven pre-take-up roller mechanism is often arranged between the thread processing spindle assembly and the take-up mechanism to overfeed the thread and reduce the thread tension.

Conventionally, the pre-take-up rollers are positively driven by a drive shaft carried by the thread processing machine in such a way that the circumferential speed thereof at the surface in contact with the thread is distinctively higher than the speed of travel of the running thread so that the running thread is subjected to a variation of its tension due to the relative speed between the pre-take-up roller and the running thread. When the circumferential speed of the pre-take-up roller is higher than the running speed of the thread, which is determined by the winding speed of the take-up mechanism, the thread tension after the pre-take-up roller is less than the thread tension before the pre-take-up roller which is desirable for effective operation of the take-up mechanism. Also, this variation in tension could be easily adjusted for various types of threads by adjustment of the rotational speed of the drive shaft.

However, since the running thread is in frictional engagement with the pre-take-up roller, the running thread is inherently subjected to undesirable frictional wear with this type of arrangement. Delicate and high quality threads, e.g. smooth filament yarns or sewing threads, are considerably damaged with the use of these conventional pre-take-up roller mechanisms at normal production rates. Such threads, therefore, must be processed at reduced production rates with a resulting, greatly reduced production capacity, in order that the thread tension prior to the pre-take-up roller is lower and does not require a great amount of additional further reduction in tension at the pre-take-up roller mechanism.

Conventional pre-take-up rollers normally utilize a ball-like structurized shape having a running groove therein in which the surface of the roller in direct contact with the running thread is either hard chromium plated or is provided with a plasma layer, such as oxide material. The degree of roughness of the surfaces of direct contact with the thread is limited. Notwithstanding, the above described problem with frictional wear by the conventional direct driven pre-take-up rollers still exist.

An example of such positively driven pre-take-up roller mechanism in a thread processing machine is disclosed in prior art U.S. Pat. No. 4,346,551.

OBJECT AND SUMMARY OF THE INVENTION

Accordingly, it is an object of this invention to provide a pre-take-up roller mechanism in a thread processing machine including a take-up mechanism for winding processed running thread at a constant speed into a package after processing by the machine which overcomes the above described problems and which provides an effective means for varying the tractive force and tension on the running thread being wound by the take-up mechanism.

By this invention, it has been determined that the above object may be accomplished by providing such a pre-take-up roller mechanism for varying the tractive force and tension on the running thread being wound by the take-up mechanism in a thread processing machine which is positioned in advance of the take-up mechanism in the running thread path and which includes generally the following.

A variably driven rotating drive shaft is carried by the machine and a thread pre-take-up roller is rotatably mounted on the drive shaft for rotation with respect thereto for receiving the running thread on the surface thereof and for being driven by the running thread through adhesion. A clutch means operatively connects the drive shaft and the pre-take-up roller for varying the torque of the pre-take-up roller and thus the tractive force and tension on the running thread without affecting the constant winding speed of the running thread being wound by the take-up mechanism.

In accordance with this invention, it has been determined that such clutch means should comprise an eddy current type clutch utilizing a permanent magnetic means positioned on and rotating with the drive shaft and a disc of electrically highly conductive material attached to one end of the pre-take-up roller and facing the permanent magnetic means and rotating with the pre-take-up roller and being spaced from the permanent magnetic means for forming an air gap of predetermined distance to create a magnetic field of desired strength in the eddy current clutch means. Alternatively, the clutch means could be in the form of a combination eddy current and hysteresis clutch means utilizing an additional disc of hysteretic material carried on the one end of the pre-take-up roller and positioned adjacent the disc of electrically highly conductive material on the side thereof opposite the side facing the permanent magnetic means. With this type of clutch means, both of the discs rotate with the pre-take-up roller and are spaced from the permanent magnetic means for forming an air gap of predetermined distance to create a magnetic field of desired strength in the combination eddy current and hysteresis clutch means. With either of these types of clutch means, it has been determined that the thread tension can be easily varied for different threads and different processing conditions requiring different constant winding speeds by varying the driven rotational speed of the driven drive shaft.

Preferably, the clutch means would include means for adjusting the predetermined distance of the air gap for further regulating the torque transmitted by the clutch means to the pre-take-up roller to accommodate different threads and different processing conditions.

Although the use of a thread tension regulator including a roller over which the thread runs and which is rotatably mounted on a drive shaft so that the roller is driven by the running yarn and which utilizes a hysteresis type clutch for operatively connecting the drive shaft and the roller is known, for example from Soviet Patent SU No. 555,183, other problems are created by the use of such hysteresis type clutch, such as the inability to vary the yarn tension by varying the driven rotational speed of the drive shaft, as will be discussed in more detail hereinafter in connection with the detailed description of the preferred embodiments of this invention in connection with the accompanying drawings. Suffice it to say at this point in the description that it has been found by the present invention that the use of an eddy current type clutch or a combination eddy current and hysteresis type clutch is necessary for obtaining the desired thread tension variability and other desired results of this invention.

By the use of the pre-take-up roller mechanism with these types of clutches in accordance with this invention, the torque on the pre-take-up roller and thus the tractive force and tension on the running thread can be varied without affecting the constant winding speed of the running thread being wound by the take-up mechanism, which is necessary in thread processing machines, such as two-for-one twisters. Additonally, the following advantages are also obtained:

(1) objectionable sliding friction wear on the running thread is eliminated at high winding speeds, (2) dependency of the effect of the tension reducing means resulting from varying perimeters of the running thread, such as coefficient or friction, content of lubricating agent, thread thickness, etc. is eliminated, (3) easier control of the reduction of thread tension within a wide range is effected, (4) good consistency and adjustability of the tension control is obtained without practical experimentation, but only by considering the known thread tension prior to the pre-take-up roller and the required tension after the pre-take-up roller, (5) the required constant speed of the running thread for the take-up mechanisms is maintained, etc.

BRIEF DESCRIPTION OF THE DRAWINGS

While some of the objects and advantages of this invention have been set forth above, other objects and advantages will appear as the detailed description of preferred embodiments of this invention continues when taken in conjunction with the accompanying drawings, in which.

DESCRIPTION OF PREFERRED EMBODIMENTS

Figure 1:
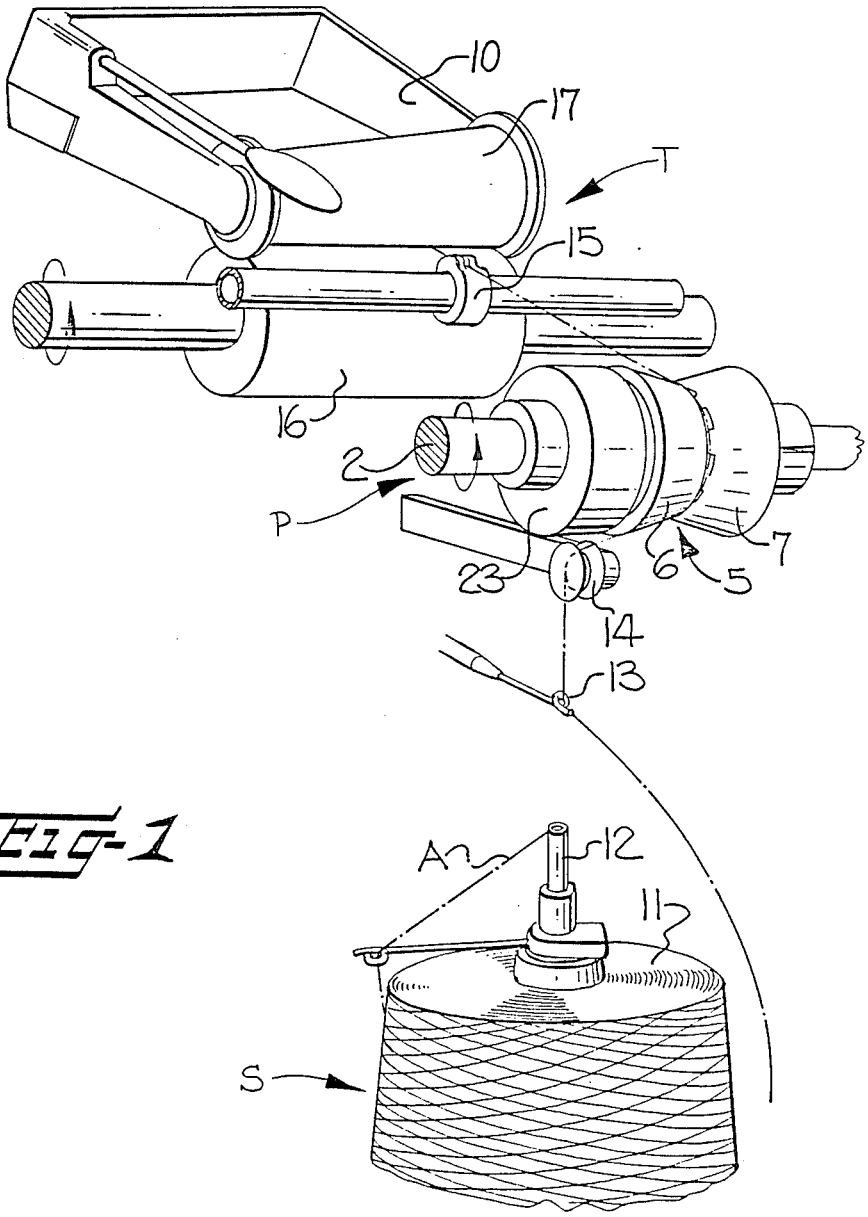
FIG. 1 is a perspective diagrammatic view of a portion of one spindle assembly station of a two-for-one twister thread processing machine utilizing the pre-take-up roller mechanism of this invention therein.

Referring now to FIG. 1, there is shown therein a perspective diagrammatic view of a portion of one spindle assembly station of a two-for-one twister thread processing machine for inserting a two-for-one twist in running thread A passing through a spindle assembly S to a take-up mechanism T for winding the processed running thread A at a constant speed into a package. In the spindle assembly S, the thread A is unwound in the usual manner from a supply bobbin 11 and passes through the hollow spindle shaft 12 of the spindle assembly S and is then fed in an upward direction in the form of a thread balloon rotating about the supply bobbin 11 to a guide 13. The thread A then travels in a known manner over a deflection pulley 14 and to the traversing mechanism 15 of the take-up mechanism T to be wound on a winding bobbin 17 which is driven by a friction roll 16 in the take-up mechanism T in a well known manner.

In accordance with this invention, a pre-take-up roller mechanism P is provided for varying the tractive force and tension on the running thread A being wound by the take-up mechanism T and is positioned in the machine in advance of the take-up mechanism T and after the spindle assembly S in the running thread path, as shown in FIG. 1.

Figure 2:
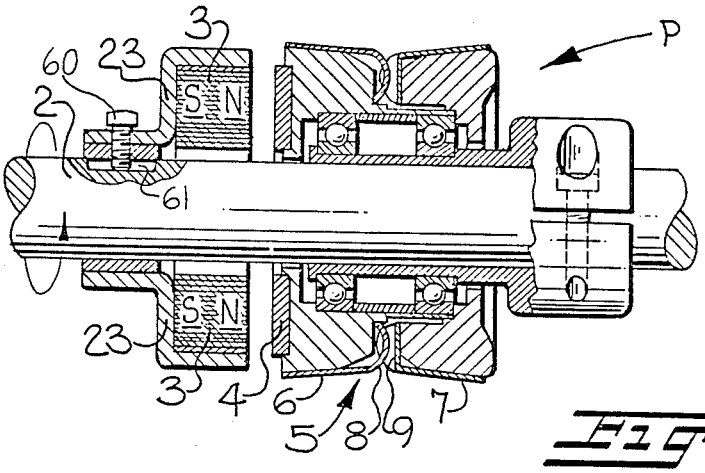
FIG. 2 is a sectional view taken through a first embodiment of a pre-take-up roller mechanism in accordance with this invention.

A first embodiment of the pre-take-up roller mechanism P, as illustrated in FIG. 2, comprises the following. A variably driven rotating shaft 2 is carried and driven by the machine and has a thread pre-take-up roller 5 rotatably mounted thereon for rotation with respect thereto for receiving the running thread A on the surface thereof and for being driven by the running thread A through adhesion. The pre-take-up roller 5 may be constructed in a conventional manner, as illustrated in FIG. 2, including two rings 6, 7 arranged side-by-side and being provided on their side faces opposing one another with ball-shaped elements 8, 9 in such a way that these elements are offset to each other to provide a groove for receiving the running thread A.

This first embodiment of pre-take-up roller mechanism P further includes an eddy current clutch means operatively connecting the drive shaft 2 and the pre-take-up roller 5 for varying the torque on the pre-take-up roller 5 and thus the tractive force and tension on the running thread A without affecting the constant winding speed of the running thread A being wound by the take-up mechanism T. This eddy current clutch means comprises a permanent magnetic means, preferably in the form of a disc 3, positively supported on the drive shaft 2 for rotation therewith. This disc 3 may be carried in a bowl-shaped holding element 23 which is preferably made of soft iron.

The eddy current clutch means further includes a disc 4 of electrically highly conductive material, such as copper, aluminum or silver, attached to one end of the pre-take-up roller for rotation therewith and facing the permanent magnetic means or disc 3 and being spaced from the disc 3 for forming an air gap of predetermined distance to create a magnetic field of desired strength in the eddy current clutch means.

Figure 3:
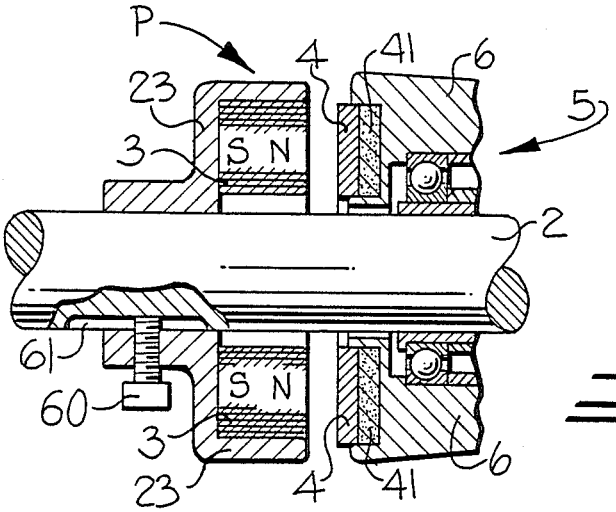
FIG. 3 is a partial sectional view through the pre-take-up roller mechanism similar to FIG. 1 and showing a further modification thereof.
Figure 4:
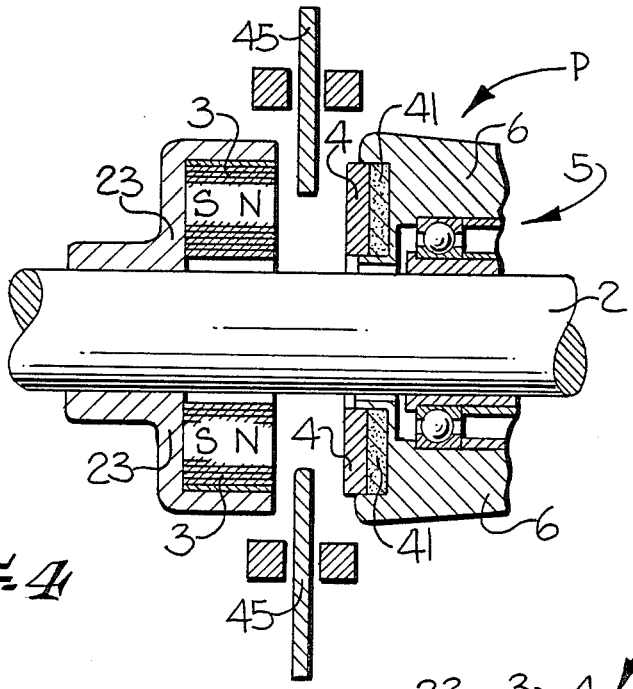
FIG. 4 is a partial sectional view through the pre-take-up roller mechanism like FIG. 3 and showing a still further modification thereof.

The eddy current clutch means may further include a magnetic return path means for enhancing the magnetic field of the eddy current clutch and which may comprise at least one soft iron disc 41 carried by the pre-take-up roller 5 and positioned adjacent the electrically highly conductive disc 4 on the side thereof opposite to the side facing the permanent magnetic means or disc 3, as shown in FIG. 3. The eddy current clutch means may further include screen means positioned in the air gap between the permanent magnetic means or disc 3 and the electrically highly conductive disc 4 for influencing the torque transmitted by the eddy current clutch means to the pre-take-up roller 5. This screen means may be in the form of rosettes or blinds 45, as illustrated in FIG. 4.

With any of the above arrangements of eddy current clutch means, means are preferably provided for adjusting the predetermined distance of the air gap between the permanent magnetic disc 3 and the electrically highly conductive disc 4 for regulating the torque transmitted by the eddy current clutch means to the pre-take-up roller 5. This adjustment means may be in the form of a slot 61 in the drive shaft 2 and a threaded bolt 60 holding the bowl-shaped element 23 in desired adjusted position along the slot 61 for adjusting the air gap.

Figure 5:
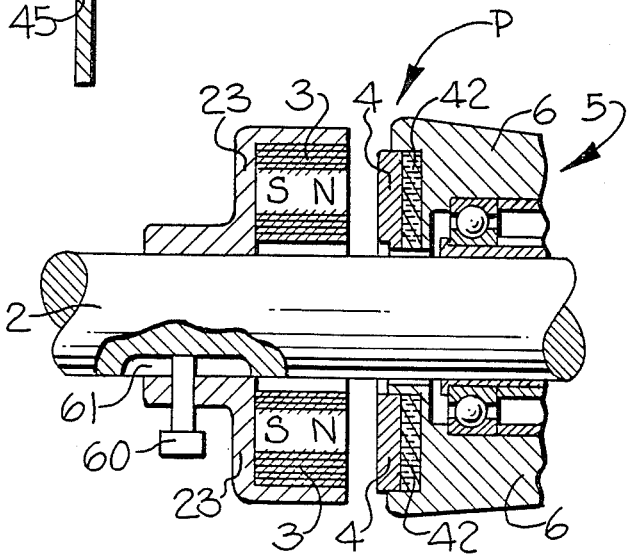
FIG. 5 is a partial sectional view through a second embodiment of a pre-take-up roller mechanism in accordance with this invention.

Alternatively, the clutch means utilized may be in accordance with a second embodiment of pre-take-up roller mechanism P, illustrated in FIG. 5, which comprises a combination eddy current and hysteresis clutch means. The other components of the pre-take-up roller mechanism P utilized in this second embodiment may be the same as described above and have been given like reference numerals. This combination eddy current and hysteresis clutch means comprises, in addition to the disc of electrically highly conductive material 4, a disc of hysteric material 42 carried on the one end of the pre-take-up roller 5 and positioned adjacent the disc of electrically highly conductive material 4 on the side thereof opposite the side facing the permanent magnetic means or disc 3. Both of the disc 4, 42 rotate with the pre-take-up roller 5. The disc 42 may be constructed of any hysteric material, for example hysteresis iron alloy.

With the embodiments of pre-take-up roller mechanisms P, described above and utilizing either an eddy current clutch means or a combination eddy current and hysteresis clutch means, a defined traction of the thread A with an adjustable reduction of tension or tractive force can be provided without the occurrence of undesirable slippage or thread friction occurring between the running thread A and the pre-take-up roller 5 upon a corresponding adjustment of the driven rotational speed of the drive shaft 2 and, thus, the relative rotational speed between the drive shaft 2 and the pre-take-up roller 5.

Figure 6:
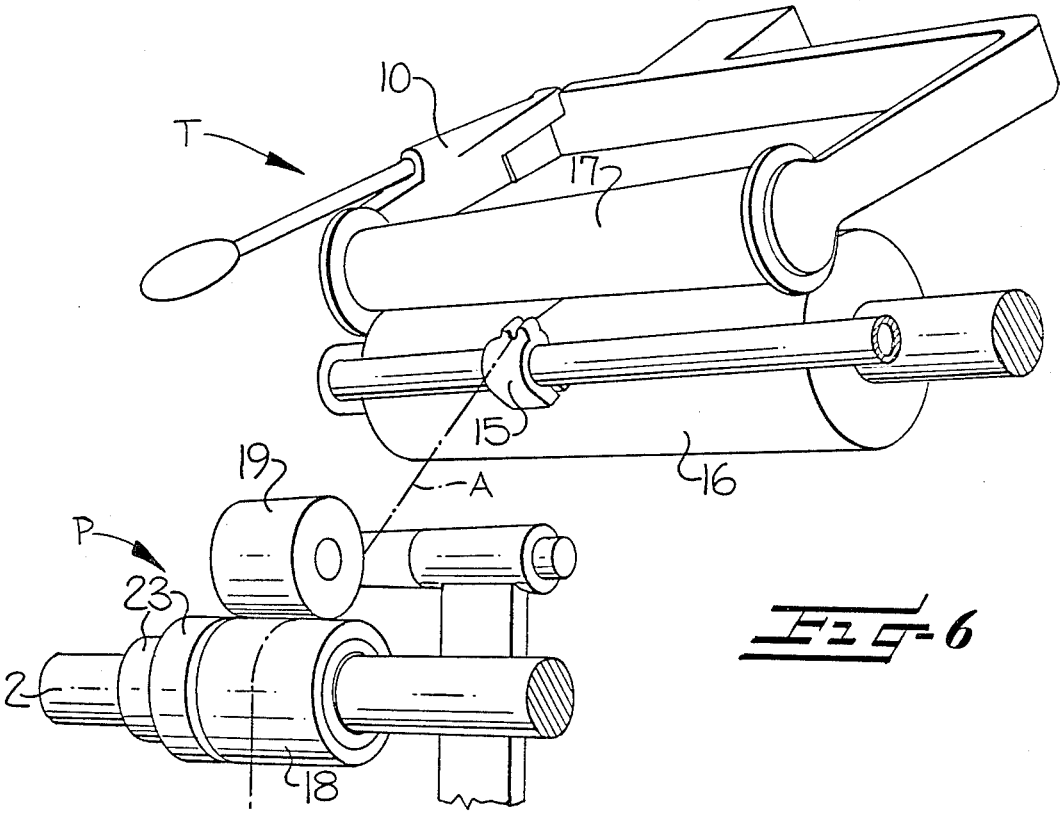
FIGS. 6 and 7 are diagrammatic perspective views of the pre-take-up roller mechanism and the take-up mechanism utilized in the thread processing machine of FIG. 1 with alternative types of counter-pressure elements associated with the pre-take-up roller mechanism.
Figure 7:
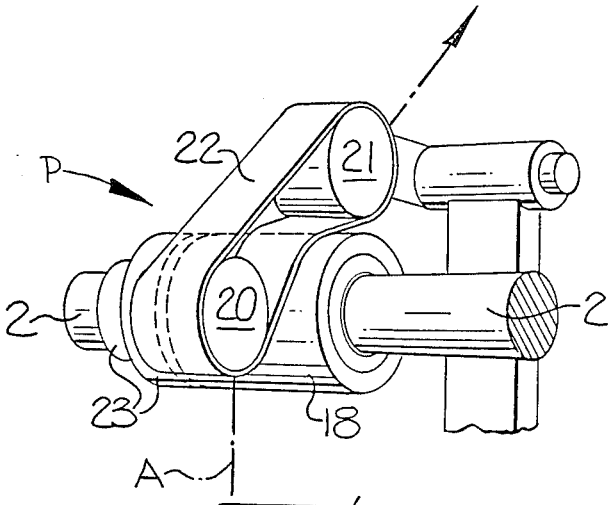

Referring now to FIGS. 6 and 7, the pre-take-up roller may be in the form of a cylindrical roller 18 having a counter pressure element which is non-positively driven abutting the outer cylindrical surface thereof. As shown in FIG. 6, this counter pressure element may be in the form of a counter pressure roll 19, e.g. capstan roll. As shown in FIG. 7, the counter pressure element may be in the form of an endless belt 22 running over rollers 20, 21. In both of these arrangements of pre-take-up rollers, the thread A passes between the cylindrical pre-take-up roller 18 and the counter pressure element 19 or 22.

Figure 8:
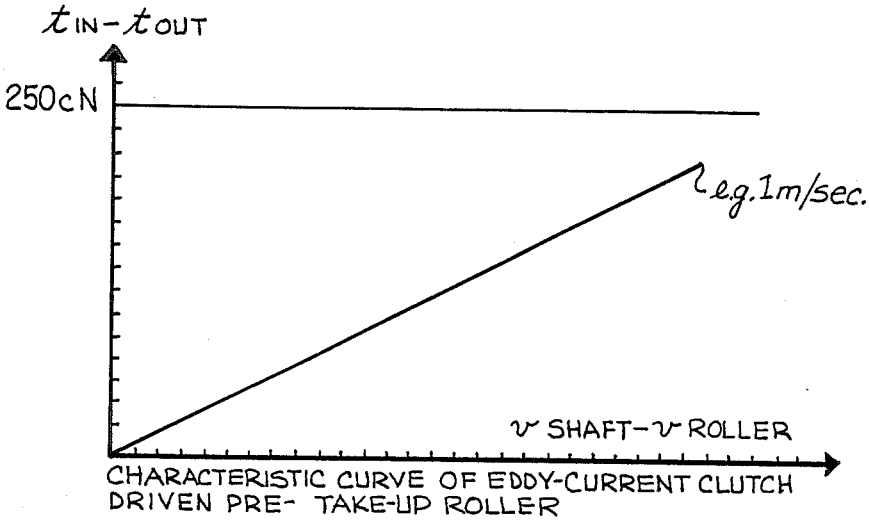
FIGS. 8–10 are charts plotting the difference in yarn tension before and after the pre-take-up roller mechanism with varying relative rotational velocities of the pre-take-up roller when the roller is driven by an eddy current clutch, a combination eddy current and hysteresis clutch, and a hysteresis clutch, respectively.
Figure 9:
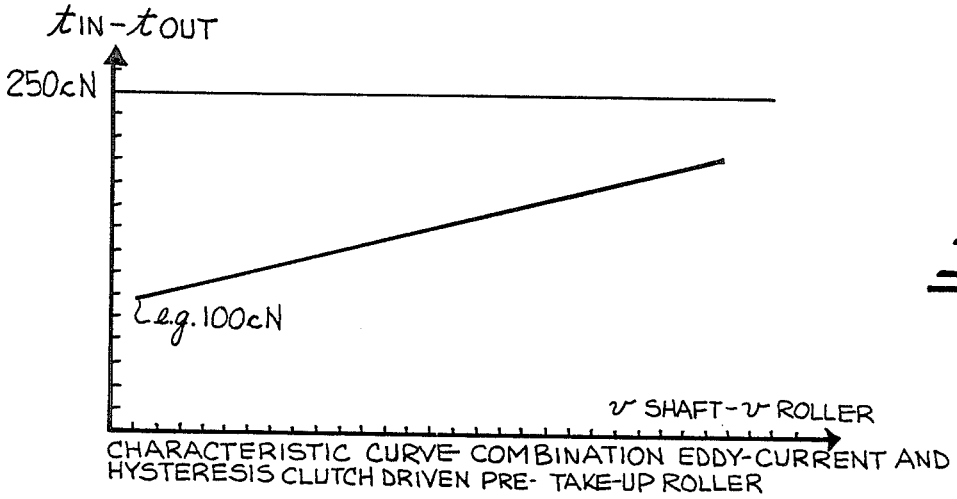
Figure 10:
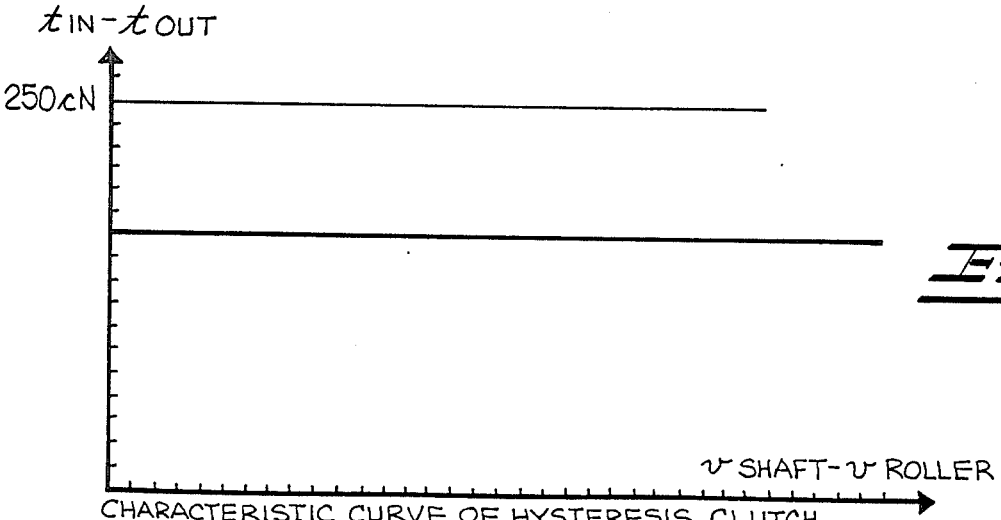

With reference to FIGS. 8–10, the advantages of the use of an eddy current clutch and a combination eddy current and hysteresis clutch, over the use of a pure hysteresis clutch, will be further discussed.

Firstly, with the use of an eddy current clutch, the torque which is transmitted thereby essentially is only proportional to the relative velocity between the permanent magnetic means or disc 3 and the electrically highly conductive disc 4, the electrical conductivity and the thickness of the electrically highly conductive disc 4 and the opposing surface of the permanent means or disc 3. The transmitted torque of the eddy current clutch is equal to the product of the difference of the incoming and outgoing thread tensions, i.e. tensions before and after the pre-take-up roller 5. At a given running speed of the thread A, it is possible to attain a precisely predictable and easily variable relation between the difference of the incoming and outgoing thread tensions and the rotational speed of the drive shaft 2 on which the permanent magnetic means or disc 3 is positively mounted. The factor of proportionality is not dependent on properties of the thread A. There is no wear on the thread A. The amount of tension reduction can easily be varied or controlled by variation of the rotational speed of the drive shaft 2.

Referring specifically to FIG. 8, this chart relates to an eddy current clutch driven pre-take-up roller and plots the relation between the difference of yarn tension ($t_{in}-t_{out}$) before the pre-take-up roller ($t_{in}$) which is also the thread balloon tension and after the pre-take-up roller ($t_{out}$) which is also the winding tension of the thread in the take-up mechanism, and the relative rotational velocity of the drive shaft and the pre-take-up roller ($v_{shaft}-v_{roller}$). As can be seen, with increasing relative velocity of the drive shaft and pre-take-up roller, the difference in yarn tensions is reduced linearly, i.e. a very differentiated control is possible by varying the rotational speed of the drive shaft.

Referring now to FIG. 9, the same characteristics are plotted with respect to the use of a combined eddy current and hysteresis clutch. As may be seen, the transmitted torque is still changed linearly with respect to the relative velocity of the drive shaft.

In contrast thereto, as seen in FIG. 10, the same values are plotted with the use of a hysteresis clutch and it may be seen that a constant characteristic is obtained with respect to the relative velocity of the drive shaft and the pre-take-up roller. Furthermore, the value of the transmitted torque with this type of clutch is proportional to the thickness of the hysteresis disc utilized in lieu of the electrically highly conductive disc, the surface of the disc and the magnetic field strength, and also from a simple function between the pole pitch distance and the value of the air gap. A control of tension by variation of the relative velocity of the drive shaft is not possible. Therefore, with the use of this type of clutch, an important possibility for adjustment of the transmitted torque by means of a very simple constructional means, i.e. adjustment of the speed of the drive shaft, is not available. An adjustment of a pure hysteresis clutch is only possible by variation of relatively complicated features, including the distance of the air gap.

Accordingly, in order to obtain a pre-take-up roller mechanism in which thread tension can be varied by varying the rotational speed of the drive shaft, the use of an eddy current or combination eddy current and hysteresis clutch means is required.

In the drawings and specification, there have been set forth preferred embodiments of the invention, and although specific terms are employed, they are used in a generic and descriptive sense only and not for purposes of limitation.

What is claimed is:

1. A thread processing machine including a take-up mechanism for winding processed running thread at a constant speed into a package after processing by said machine, said take-up mechanism including means for driving the package at a constant peripheral speed; the combination therewith of pre-take-up roller means for varying the tractive force and tension on the running thread being wound by said take-up mechanism and positioned in said machine in advance of said take-up mechanism in the running thread path, said means comprising:

a variably driven rotating drive shaft carried by said machine, a thread pre-take-up roller rotatably mounted on said drive shaft for rotation with respect thereto for receiving the running thread on the surface thereof and for being driven by the running thread through adhesion, and an eddy current clutch means operatively connecting said drive shaft and said pre-take-up roller for varying the torque of said pre-take-up roller and thus the tractive force and tension on the running thread by varying the driven rotational speed of said drive shaft while maintaining the constant winding speed of the running thread being wound by said take-up mechanism, said eddy current clutch means comprising permanent magnetic means positioned on and rotating with said drive shaft and a disc of electrically highly conductive material attached to one end of said pre-take-up roller and facing said permanent magnetic means and rotating with said pre-take-up roller and being spaced from said permanent magnetic means for forming an air gap of predetermined distance to create a magnetic field of desired strength in said eddy current clutch means.

2. A thread processing machine including a take-up mechanism for winding processed running thread at a constant speed into a package after processing by said machine, said take-up mechanism including means for driving the package at a constant peripheral speed; the combination therewith of pre-take-up roller means for varying the tractive force and tension on the running thread being wound by said take-up mechanism and positioned in said machine in advance of said take-up mechanism in the running thread path, said means comprising:

a driven rotating drive shaft carried by said machine, a thread pre-take-up roller rotatably mounted on said drive shaft for rotation with respect thereto for receiving the running thread on the surface thereof and for being driven by the running thread through adhesion, and a combination eddy current and hysteresis clutch means operatively connecting said drive shaft and said pre-take-up roller for varying the torque of said pre-take-up roller and thus the tractive force and tension on the running thread by varying the driven rotational speed of said drive shaft while maintaining the constant winding speed of the running thread being wound by said take-up mechanism, said eddy current and hysteresis clutch means comprising permanent magnetic means positioned on and rotating with said drive shaft and a disc of electrically highly conductive material carried on one end of said pre-take-up roller and having one side thereof facing said permanent magnetic means and a disc of hysteretic material carried on the one end of said pre-take-up roller and positioned adjacent said disc of electrically highly conductive material on the side thereof opposite the side facing said permanent magnetic means, both of said discs rotating with said pre-take-up roller and being spaced from said permanent magnetic means for forming an air gap of predetermined distance to create a magnetic field of desired strength in said eddy current and hystersis clutch means.

3. A two-for-one twister thread processing machine including a spindle assembly for inserting a two-for-one twist in running thread passing therethrough and a take-up mechanism for winding the processed running thread at a constant speed into a package after passing through said spindle assembly; the combination therewith of pre-take-up roller means for varying the tractive force and tension on the running thread being wound by said take-up mechanism and positioned in said machine in advance of said take-up mechanism and after said spindle assembly in the running thread path, said means comprising:

a driven rotating drive shaft carried by said machine, a thread pre-take-up roller rotatably mounted on said drive shaft for rotation with respect thereto for receiving the running thread on the surface thereof and for being driven by the running thread through adhesion, and an eddy current clutch means operatively connecting said drive shaft and said pre-take-up roller for varying the torque of said pre-take-up roller and thus the tractive force and tension on the running thread by varying the driven rotational speed of said drive shaft while maintaining the constant winding speed of the running thread being wound by said take-up mechanism, said eddy current clutch means comprising permanent magnetic means positioned on and rotating with said drive shaft and a disc of electrically highly conductive material attached to one end of said pre-take-up roller and facing said permanent magnetic means and rotating with said pre-take-up roller and being spaced from said permanent magnetic means for forming an air gap of predetermined distance to create a magnetic field of desired strength in said eddy current clutch means.

4. A two-for-one thread processing machine including a spindle assembly for inserting a two-for-one twist in running thread passing therethrough and a take-up mechanism for winding the processed running thread at a constant speed into a package after passing through said spindle assembly; the combination therewith of pre-take-up roller means for varying the tractive force and tension on the running thread being wound by said take-up mechanism and positioned in said machine in advance of said take-up mechanism and after said spindle assembly in the running thread path, said means comprising:

a driven rotating drive shaft carried by said machine, a thread pre-take-up roller rotatably mounted on said drive shaft for rotation with respect thereto for receiving the running thread on the surface thereof and for being driven by the running thread through adhesion, and a combination eddy current and hysteresis clutch means operatively connecting said drive shaft and said pre-take-up roller for varying the torque of said pre-take-up roller and thus the tractive force and tension on the running thread by varying the driven rotational speed of said drive shaft while maintaining constant winding speed of the running thread being wound by said take-up mechanism, said eddy current and hysteresis clutch means comprising permanent magnetic means positioned on and rotating with said drive shaft and a disc of electrically highly conductive material carried on one end of said pre-take-up roller and having one side thereof facing said permanent magnetic means and a disc of hysteretic material carried on the one end of said pre-take-up roller and positioned adjacent said disc of electrically highly conductive material on the side thereof opposite the side facing said permanent magnetic means, both of said discs rotating with said pre-take-up roller and being spaced from said permanent magnetic means for forming an air gap of predetermined distance to create a magnetic field of desired strength in said eddy current and hysteresis clutch means.

5. A machine, as set forth in claim 1 or 3 in which said eddy current clutch means further includes magnetic return path means for enhancing the magnetic field of said eddy current clutch and comprising at least one soft iron disc carried by said pre-take-up roller and positioned adjacent said electrically highly conductive disc on the side thereof opposite to the side facing said permanent magnetic means.

6. A machine, as set forth in claim 1, 2, 3 or 4, in which said clutch means further includes means for adjusting the predetermined distance of the air gap for regulating the torque transmitted by said clutch means to said pre-take-up roller.

7. A machine, as set forth in claim 1, 2, 3 or 4, in which said clutch means further includes screen means positioned in the air gap for influencing the torque transmitted by said clutch means to said pre-take-up roller.

8. A machine, as set forth in claim 1, 2, 3 or 4, in which said pre-take-up roller further includes counter pressure means non-positively driven by said roller and abutting the surface thereof receiving the running thread therebetween.

9. A machine, as set forth in claim 8, in which said counter pressure means comprises a roll.

10. A machine, as set forth in claim 8, in which said counter pressure means comprises an endless belt.

* * * * *